US006389599B2

(12) United States Patent
Spiegel

(10) Patent No.: US 6,389,599 B2
(45) Date of Patent: May 21, 2002

(54) METHOD EMPLOYING A SOUND INSULATED SLEEVE FOR QUIETLY OPENING A WRAPPED PRODUCT

(76) Inventor: H. Jay Spiegel, P.O. Box 444, Mt. Vernon, VA (US) 22121

( * ) Notice: Subject to any disclaimer, the term of this patent is extended or adjusted under 35 U.S.C. 154(b) by 0 days.

(21) Appl. No.: 09/862,301

(22) Filed: May 23, 2001

Related U.S. Application Data

(62) Division of application No. 09/598,510, filed on Jun. 21, 2000.

(51) Int. Cl.[7] ..... A41D 27/02
(52) U.S. Cl. ..... 2/91
(58) Field of Search ..... 2/158, 66, 91, 2/208; D2/611

(56) References Cited

U.S. PATENT DOCUMENTS 482,432 A * 9/1892 Ashbaugh
2,611,901 A * 9/1952 Neider ..... 2/158
2,751,952 A * 6/1956 Mirus ..... 150/5
4,408,355 A * 10/1983 Brock ..... 2/66
4,495,359 A * 1/1985 Madnick et al. ..... 2/66
4,884,297 A * 12/1989 Triche ..... 2/16
4,893,357 A * 1/1990 Evans ..... 2/208
5,139,187 A * 8/1992 Fowler ..... 224/151
5,269,023 A * 12/1993 Ross ..... 2/66
5,499,401 A * 3/1996 Heinmiller ..... 2/208
D371,892 S * 7/1996 Geer ..... D2/611
5,618,263 A * 4/1997 Alivizatos ..... 602/6
6,192,543 B1 * 2/2001 Lee ..... 15/118

* cited by examiner

*Primary Examiner*—John J. Calvert
*Assistant Examiner*—Alissa L. Hoey
(74) *Attorney, Agent, or Firm*—H. Jay Spiegel

(57) ABSTRACT

A sleeve has an outer aesthetic covering lined with a sound absorbing material with the inner surfaces of the sound absorbing material being covered with a further covering. Each end of the sleeve is open and gathers about the wrists of the user when in use. The device can take the form of a container made of any desired shape such as spherical, rectangular cubic, square cubic, or any other desired configuration including two openings allowing access to the interior chamber by the hands of the user and structure to gather the periphery of each opening about the wrist of the user to seal the chamber with the hands of the user within the chamber. The device is employed by inserting a wrapped candy bar or other treat through one of the openings and into the internal chamber of the device. The hands are inserted through the respective openings and the openings are gathered in any suitable manner about the wrists to seal the enclosed chamber from emission of sound. The hands are used within the chamber to manipulate the candy bar to open the wrapper while preventing most, if not all, sound emission. Once the candy bar has been unwrapped, it may be removed along with the wrapper through one of the openings of the device and may be eaten.

17 Claims, 1 Drawing Sheet

METHOD EMPLOYING A SOUND INSULATED SLEEVE FOR QUIETLY OPENING A WRAPPED PRODUCT

This application is a divisional of Ser. No. 09/598,510, filed on Jun. 21, 2000.

BACKGROUND OF THE INVENTION

The present invention relates to a method of employing a sound insulated sleeve for quietly opening a wrapped product. Recently, a study was conducted to determine whether opening a candy bar wrapper slowly results in a reduction in noise emission over opening a candy bar wrapper quickly. The study concluded that either technique results in emission of an equivalent amount of noise.

As such, it has now been scientifically determined that opening a candy bar wrapper slowly within a feeder or stadium does nothing to diminish the disturbance of that act.

There has always been a need for some device that would permit one to quietly open a candy bar wrapper within a feeder or stadium. It is with this need in mind that the present invention was developed.

SUMMARY OF THE INVENTION

The present invention relates to a method of employing a sound insulated sleeve for quietly opening a wrapped product. The present invention includes the following interrelated objects, aspects and features:

(1) In a preferred embodiment of the present invention, a sleeve is provided having an outer aesthetic covering lined with a sound absorbing material with the inner surfaces of the sound absorbing material being covered with a further covering.

(2) Each end of the sleeve is open and includes structure to cause the opening to gather about the wrists of the user when in use. One embodiment of such gathering consists of sealing means comprising elastic installed about the periphery of each opening and tending to compress the opening so that it gathers about the wrist of the user. In an alternative embodiment, the sealing means comprises a string such as a shoestring that may be threaded through an annular chamber, extending out through one or two openings formed in the end of the sleeve with the user pulling the string to tighten the opening about the wrist of the user.

(3) If desired, as an alternative, the inventive device can take the form of a container made of any desired shape such as spherical, rectangular cubic, square cubic, or any other desired configuration including two openings allowing access to the interior chamber by the hands of the user and some means to gather the periphery of each opening about the wrist of the user to seal the chamber with the hands of the user therein.

(4) In any event, the inventive device in any one of its embodiments is employed by inserting a wrapped candy bar or other treat through one of the openings and into the internal chamber of the device. The hands are inserted through the respective openings and the openings are gathered in any suitable manner about the wrists to seal the enclosed chamber from emission of sound. The hands are used within the chamber to manipulate the candy bar to open the wrapper while preventing most, if not all, sound emission. Once the candy bar has been unwrapped, it may be removed along with the wrapper through one of the openings of the device and may be eaten.

As such, it is a first object of the present invention to provide a method of employing a sound insulated sleeve for quietly opening a wrapped product.

It is a further object of the present invention to provide such a method in which the openings of the sleeve are gathered so that they tightly surround the wrists of the user when the user's hands are placed within the chamber thereof.

It is a still further object of the present invention to provide such a method wherein such gathering is accomplished through elastic material.

It is a still further object of the present invention to provide such a method in which the gathering is provided through a circumferentially extending string.

It is a yet further object of the present invention to provide such a method in which the chamber is made in a polygonal shape such as, for example, rectangular cubic, square cubic and the like.

It is a yet further object of the present invention to provide such a method which is made in a spherical shape.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
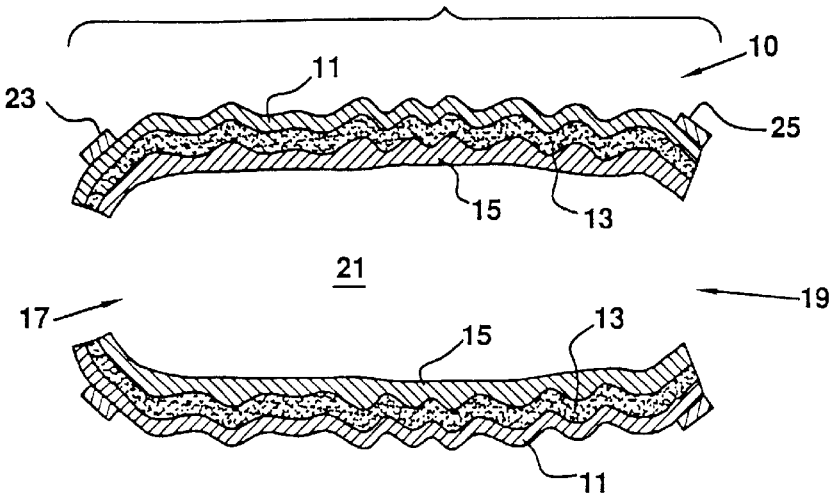
FIG. 1 shows a cross-sectional view through a preferred embodiment of the device used in the present invention.
Figure 2:
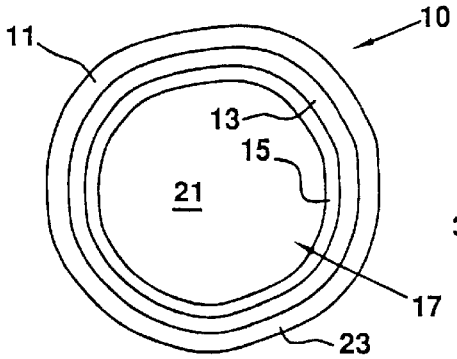
FIG. 2 shows an end view of the device shown in FIG. 1.

With reference, first, to FIGS. 1 and 2, a first embodiment of the device used in the present invention is generally designated by the reference numeral 10 and is seen to include an outer aesthetic covering 11, a sound insulative lining 13 and a further lining 15 wherein the sound insulative lining 13 is sandwiched between the covering 11 and the lining 15.

As best seen in FIG. 1, the sleeve 10 includes opposed openings 17 and 19 which lead to an internal chamber 21. The opening 17 is gathered in a direction toward closing of the opening 17 by a circumferential piece of elastic 23 suitably sewn onto the outer covering 11. Similarly, a piece of elastic 25 is sewn about the periphery of the opening 19 for the same purpose.

In the preferred method of the present invention, the sound insulative layer 13 may be made of any suitable material such as fiberglass, foam or any material that resists transmission therethrough of sound waves. Put another way, the material for the lining 13 should efficiently absorb sound waves. Such materials are well known.

In the operation of the embodiment of FIGS. 1–2, a user inserts a wrapped product such as a candy bar within the chamber 21 and inserts their hands into the respective openings 17 and 19 with the elastic pieces 23, 25 causing the openings 17 and 19, respectively, to gather about the wrists of the user to create sealing means causing the chamber 21 to become sealed and air tight. The user then manipulates their hands to open the candy bar wrapper and remove the piece of candy therefrom. This having been accomplished, the candy bar and its wrapper may easily be removed through one or the other of the openings 17 and 19, whereupon the wrapper may be discarded and the candy bar may be consumed.

Figure 3:
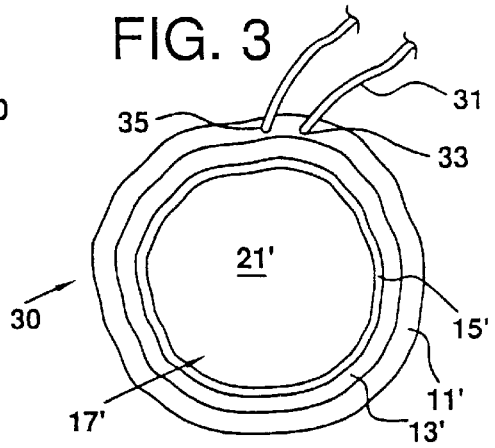
FIG. 3 shows an end view of a modification of the device of FIGS. 1 and 2.

With reference to FIG. 3, an alternative construction of the device 10 is shown in which like elements are referred to with like primed reference numerals.

The device 30 illustrated in FIG. 3 includes an outer aesthetic covering 11', a sound insulative lining 13' and an inner lining 15'. The opening 17' leads to a chamber 21'. Instead of the elastic 23, an elongated string 31 is provided that is threaded circumferentially through the outer covering 11' via the openings 33 and 35 shown. Such a structure is similar to the well known drawstrings used to tighten the waistband of a pair of sweatpants.

Similar structure is provided for the opening 19' (not shown).

The operation of the embodiment illustrated in FIG. 3 is similar to that of the embodiment of FIGS. 1 and 2. After the hands are inserted into the chamber 21', the string 31 and a corresponding string (not shown) with respect to the opening 19' (not shown) are tightened to cause the chamber 21' to be air tight about the wrists of the user. Thereafter, operation is the same as that of the device 10, although after the product wrapper has been opened, the strings including the string 31 are suitably loosened to allow the hands to be removed from the chamber 21'.

Figure 4:
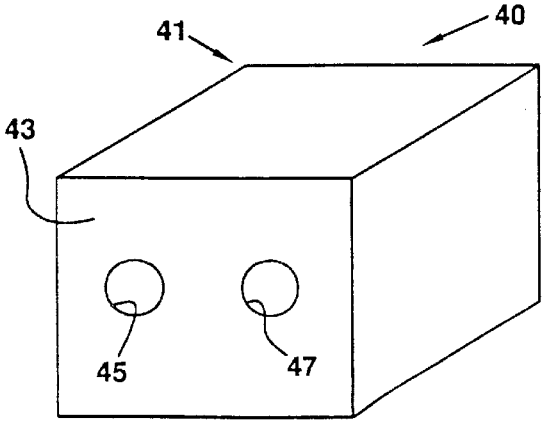
FIG. 4 shows a further embodiment of the device used in the present invention.

FIG. 4 shows a further embodiment of the present invention designated by the reference numeral 40 and seen to include an outer housing 41 that is made in a rectangular cubic or square cubic configuration. One face 43 includes two openings 45 and 47 therethrough corresponding to the openings 17 and 19. The openings 45 and 47 may be provided with a tendency to gather about the wrists of the user through the use of elastic such as is disclosed with respect to the embodiment of FIGS. 1 and 2 or with a drawstring such as the drawstring 31 illustrated in FIG. 3 or through any other suitable means. Alternatively, the openings 45 and 47 may be respectively provided in opposed or adjacent panels of the housing 41.

Figure 5:
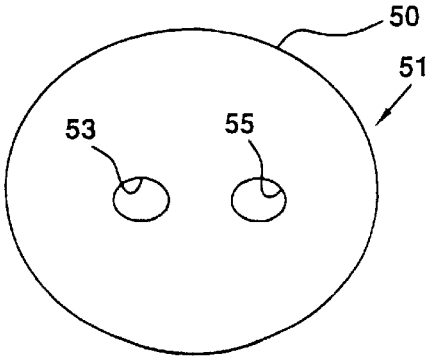
FIG. 5 shows a still further embodiment of the device used in the present invention.

FIG. 5 shows a further embodiment 50 in which the housing 51 is generally spherical or elliptical and the openings 53 and 55 are adjacent to one another. Of course, the openings 53 and 55 may be placed on opposed portions of the housing 51 or separated from one another by any desired degree. As is the case with the embodiment of FIG. 4, the openings 53 and 55 may tend to gather about the wrists of the user in any suitable way such as is disclosed hereinabove.

In all of the embodiments of the present invention set forth hereinabove, the outer covering 11 and inner lining 15 may be omitted provided the sound insulative material such as that designated by the reference numeral 13 has the structural integrity to enclose the hands and wrists of the user without damage thereto.

With reference to FIG. 1, if either the covering 11 or the lining 15 or both are to be included, they each may be made of any suitable material such as cloth or plastic or rubber. The sole purpose for the covering 11 is to provide an aesthetic cover for the device and, if necessary, to provide structural integrity to the sound insulative lining 13. The sole purpose for the lining 15 is to maintain the structural integrity of the sound insulative lining 13 and, if necessary, to preclude engagement of the lining 13 with the hands of the user. For example, where the lining 13 is made of fiberglass material, it would be best to avoid direct contact with that material by the hands of the user to avoid fiberglass splinters from entering the hands of the user.

As should be evident, the embodiments of FIGS. 4 and 5 operate in a similar manner to those of FIGS. 1–3. The user inserts a wrapped product inside the housing 41 or 51 through one of the openings 45, 47 or 53, 55 and thereafter inserts their hands into the openings with the openings gathering about the wrists thereof to provide a sealed chamber. The wrapper is manipulated and opened and is thereafter removed through one of the openings along with the unwrapped product.

Of course, as should be understood by those skilled in the art, the wrapped product can be placed within the sound insulated chamber after one hand is inserted therein.

As such, an invention has been disclosed in terms of preferred embodiments thereof which fulfill each and every one of the objects of the invention as set forth hereinabove and provide new and useful embodiments of a method of using a sound insulated device for quietly opening wrapped products.

Of course, various changes, modifications and alterations in the teachings of the present invention may be contemplated by those skilled in the art without departing from the intended spirit and scope thereof.

As such, it is intended that the present invention only be limited by the terms of the appended claims.

What is claimed is:

1. A method for quietly opening a wrapped product, including the steps of:

a) providing a device including:
   i) a body made of a sound absorbing material and defining an internal chamber;
   ii) first and second openings in said body allowing access to said chamber, each of said openings being sized to closely receive therethrough a human hand inserted from outside said body; and
   iii) sealing means for sealingly engaging each of said openings around a hand or wrist of a user;

b) inserting a product, enclosed by a wrapping, within said chamber;

c) inserting a user's hands into said chamber through said first and second openings from outside said body;

d) sealing said openings about said user's hands and/or wrists;

e) manipulating fingers of said hands to open said wrapping;

f) removing said product from said wrapping; and g) removing said hands, product and wrapping from said chamber.

2. The method of claim 1, wherein said product and wrapping are inserted into said chamber after one of said hands is inserted into one of said openings.

3. The method of claim 1, wherein said body comprises a sleeve.

4. The method of claim 3, wherein said openings are at opposed ends of said sleeve.

5. The method of claim 3, wherein said sealing means comprises an elastic material attached about each opening.

6. The method of claim 3, wherein said sealing means comprises a drawstring.

7. The method of claim 1, further including the step of covering said body with a covering.

8. The method of claim 7, further including the step of providing an inner lining within said chamber.

9. The method of claim 1, wherein said sound absorbing material comprises fiberglass.

10. The method of claim 1, wherein said sound absorbing material comprises foam.

11. A method for quietly opening a wrapped product, including the steps of:

a) providing a device including:

i) a body comprising an elongated sleeve defining an internal chamber and made of a sound absorbing material;

ii) first and second openings at opposed ends of said sleeve allowing access to said chamber, each of said openings being sized to receive therethrough a human hand; and iii) sealing means for sealingly engaging each of said openings around a hand or wrist of a user;

b) inserting a first hand of a user through one of said openings;

c) inserting a product, enclosed by a wrapping, within said chamber;

d) inserting a second hand of a user through another of said openings;

e) sealing said openings about said user's hands and/or wrists;

f) manipulating fingers of said hands to open said wrapping;

g) removing said product from said wrapping; and h) removing said hands, product and wrapping from said chamber.

12. The method of claim 11, wherein said sealing means comprises an elastic material attached about each opening.

13. The method of claim 11, wherein said sealing means comprises a drawstring.

14. The method of claim 11, further including the step of covering said sleeve with a covering.

15. The method of claim 14, further including the step of providing a lining within said chamber.

16. The method of claim 11, wherein said sound absorbing material comprises fiberglass.

17. The method of claim 11, wherein said sound absorbing material comprises foam.

* * * * *